US006735399B2

(12) United States Patent
Tabb et al.

(10) Patent No.: US 6,735,399 B2
(45) Date of Patent: May 11, 2004

(54) POST-LAUNCH PROCESS OPTIMIZATION OF REPLACEABLE SUB-ASSEMBLY UTILIZATION THROUGH CUSTOMER REPLACEABLE UNIT MEMORY PROGRAMMING

(75) Inventors: Charles H. Tabb, Rochester, NY (US); Scott M. Silence, Fairport, NY (US); Jane M. Kanehl, Bloomfield, NY (US); Douglas A. Kreckel, Webster, NY (US)

(73) Assignee: Xerox Corporation, Stamford, CT (US)

( * ) Notice: Subject to any disclaimer, the term of this patent is extended or adjusted under 35 U.S.C. 154(b) by 4 days.

(21) Appl. No.: 10/151,121

(22) Filed: May 17, 2002

(65) Prior Publication Data

US 2003/0215246 A1 Nov. 20, 2003

(51) Int. Cl.[7] ..... G03G 15/00

(52) U.S. Cl. ..... 399/8; 399/12; 399/24; 399/25; 399/27

(58) Field of Search ..... 399/12, 13, 24–26, 399/8, 27

(56) References Cited

U.S. PATENT DOCUMENTS 4,496,237 A 1/1985 Schron
4,827,308 A 5/1989 Howard et al.
4,961,088 A 10/1990 Gilliland et al.
5,272,503 A 12/1993 LeSueur et al.
5,835,817 A * 11/1998 Bullock et al. ..... 399/25
5,930,553 A * 7/1999 Hirst et al. ..... 399/8
6,016,409 A 1/2000 Beard et al.
6,459,860 B1 * 10/2002 Childers ..... 399/12
6,498,905 B1 * 12/2002 Tsuruya ..... 399/12

* cited by examiner

*Primary Examiner*—William J. Royer
(74) *Attorney, Agent, or Firm*—Christopher D. Wait

(57) ABSTRACT

The present invention relates to utilizing memory provided in a machine replaceable sub-assembly to be one medium of distribution for software code updates to that machine relating as to how that machine should use that replaceable sub-assembly. In one embodiment, there is provided a replaceable sub-assembly for use in a machine at various setpoints including a memory and further including upgraded executable instruction suitable for directing the machine to use the replaceable sub-assembly with different setpoints, where the upgraded executable instruction is stored in the memory. In this way, the replaceable sub-assembly becomes the medium for it's own or another's software updates.

23 Claims, 4 Drawing Sheets

POST-LAUNCH PROCESS OPTIMIZATION OF REPLACEABLE SUB-ASSEMBLY UTILIZATION THROUGH CUSTOMER REPLACEABLE UNIT MEMORY PROGRAMMING

RELATED CASES

Cross reference is made to the following related applications incorporated by reference herein: U.S. application Ser. No. 10/151,123, entitled "MACHINE POST-LAUNCH PROCESS OPTIMIZATION THROUGH CUSTOMER REPLACEABLE UNIT MEMORY PROGRAMMING" to Scott M. Silence, Jane M. Kanehl, Douglas A. Kreckel, and Charles H. Tabb; and, U.S. application Ser. No. 10/151,122, entitled "POST-LAUNCH PROCESS OPTIMIZATION OF REPLACEABLE SUB-ASSEMBLY UTILIZATION THROUGH CUSTOMER REPLACEABLE UNIT MEMORY PROGRAMMING PROVIDED IN AN ALTERNATE REPLACEABLE SUB-ASSEMBLY" to Scott M. Silence, Jane M, Kanehl, Douglas A. Kreckel, and Charles H. Tabb.

BACKGROUND

The present invention relates generally to the updating of software code. The invention relates more generally to the utilization of commonly replaced system parts. The invention relates more importantly to memory provided in commonly replaced system parts. The invention relates in particular with regards to a Customer Replaceable Unit (CRU) and a Customer Replaceable Unit Monitor (CRUM).

Many machines have replaceable sub-assemblies. Printing machines for example may have a number of replaceable sub-assemblies such as a fuser print cartridge, a toner cartridge, or an automatic document handler. These subassemblies may be arranged as a unit called a cartridge, and if intended for replacement by the customer or machine owner, may be referred to as a CRU. Examples of a CRU may include a printer cartridge, toner cartridge, or transfer assembly unit. It may be desirable for a CRU design to vary over the course of time due to manufacturing changes or to solve post launch problems with either: the machine, the CRU, or a CRU and machine interaction. Further, design optimizations may be recognized subsequent to design launch and machine sale, that a relatively simple code update might realize. However, solving these problems, or providing optimization updates, generally requires a field call.

In U.S. Pat. No. 4,496,237 to Schron, the invention described discloses a reproduction machine having a nonvolatile memory for storing indications of machine consumable usage such as photoreceptor, exposure lamp and developer, and an alphanumeric display for displaying indications of such usage. In operation, a menu of categories of machine components is first scrolled on the alphanumeric display. Scrolling is provided by repetitive actuation of a scrolling switch. Having selected a desired category of components to be monitored by appropriate keyboard entry, the sub-components of the selected category can be scrolled on the alphanumeric display. In this manner, the status of various consumables can be monitored and appropriate instructions displayed for replacement. In another feature, the same information on the alphanumeric display can be remotely transmitted.

In U.S. Pat. No. 4,961,088 to Gilliland et al., there is disclosed a monitor/warranty system for electrostatographic reproducing machines in which replaceable cartridges providing a predetermined number of images are used, each cartridge having an EEPROM programmed with a cartridge identification number that when matched with a cartridge identification number in the machine enables machine operation, a cartridge replacement warning count, and a termination count at which the cartridge is disabled from further use, the EEPROM storing updated counts of the remaining number of images left on the cartridge after each print run.

U.S. Pat. No. 5,272,503 to LeSueur et al., provides a printing machine, having operating parameters associated therewith, for producing prints. The printing machine includes a controller for controlling the operating parameters and an operator replaceable sub-assembly adapted to serve as a processing station in the printing machine. The operator replaceable sub-assembly includes a memory device, communicating with the controller when the replaceable sub-assembly is coupled with the printing machine, for storing a value which varies as a function of the usage of the replaceable sub-assembly, the controller adjusting a selected one of the operating parameters in accordance with the stored value for maintaining printing quality of the printing machine.

In U.S. Pat. No. 6,016,409 to Beard et al., there is disclosed a fuser module, being a fuser subsystem installable in a xerographic printing apparatus, which includes an electronically-readable memory permanently associated therewith. The control system of the printing apparatus reads out codes from the electronically-readable memory at installation to obtain parameters for operating the module, such as maximum web use, voltage and temperature requirements, and thermistor calibration parameters.

All of the patents indicated above are herein incorporated by reference in their entirety for their teaching.

Therefore, as discussed above, there exists a need for an arrangement and methodology which will solve the problem of providing software code updates without the need for a field service call. Thus, it would be desirable to solve this and other deficiencies and disadvantages as discussed above with an improved methodology for updating machine software code.

The present invention relates to a method for operating a machine comprising the steps of providing a replaceable sub-assembly separable from the machine, the replaceable sub-assembly further comprising a memory, the memory having stored within it a software code upgrade of executable instructions relating to the utilization of the replaceable sub-assembly. This is then followed by placing the replaceable sub-assembly into the machine, reading the memory and placing the stored software code upgrade into the machine as new executable instructions. The final step being operating the machine with the replaceable subassembly in accordance with the new executable instructions.

Further, the present invention relates to a replaceable sub-assembly for use in a machine at various setpoints. The replaceable sub-assembly comprising a memory and upgraded executable instructions suitable for directing the machine to use the replaceable sub-assembly with different setpoints, where the upgraded executable instructions are stored in the memory.

In particular, the present invention relates to a method for operating a printer apparatus comprising the step of providing a customer replaceable unit separable from the printer apparatus, the customer replaceable unit further comprising a memory, the memory having stored within a software code upgrade of executable instructions relating to the utilization of the customer replaceable unit.

DESCRIPTION

By providing additional storage in a replaceable unit or cartridge or CRU and taking proper advantage of that storage or storage already present, various problems associated with post launch optimization and updates may be accomplished.

By expanding the use of a CRUM memory, a machine, if equipped according to the teachings provided herein, may be availed of software updates that while not requiring immediate installation, never-the-less remain eminently desirable. In effect the CRUM or other cartridge memory becomes the media and medium of distribution for new code installation or updates.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
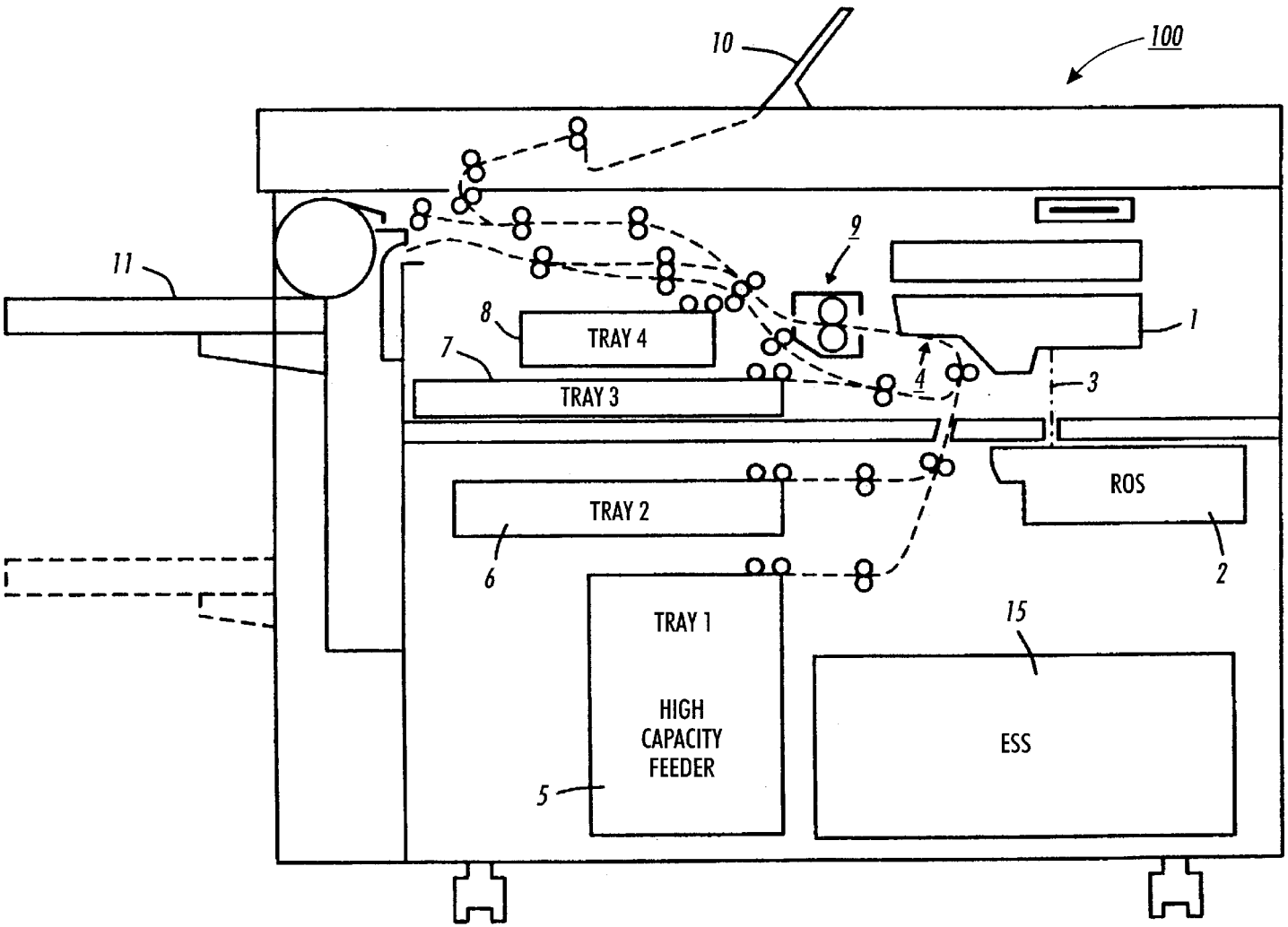
FIG. 1 depicts a schematical representation of a printing machine.
Figure 2:
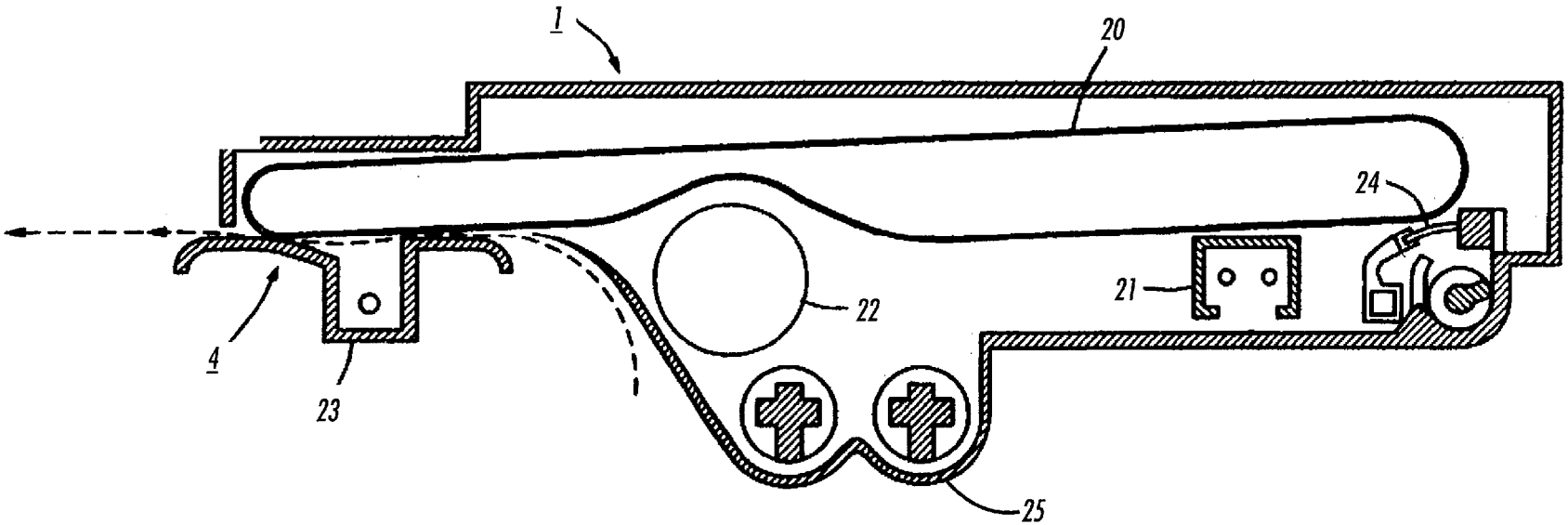
FIG. 2 depicts a cross-sectional view of a replaceable sub-assembly or CRU for the machine of FIG. 1.
Figure 3:
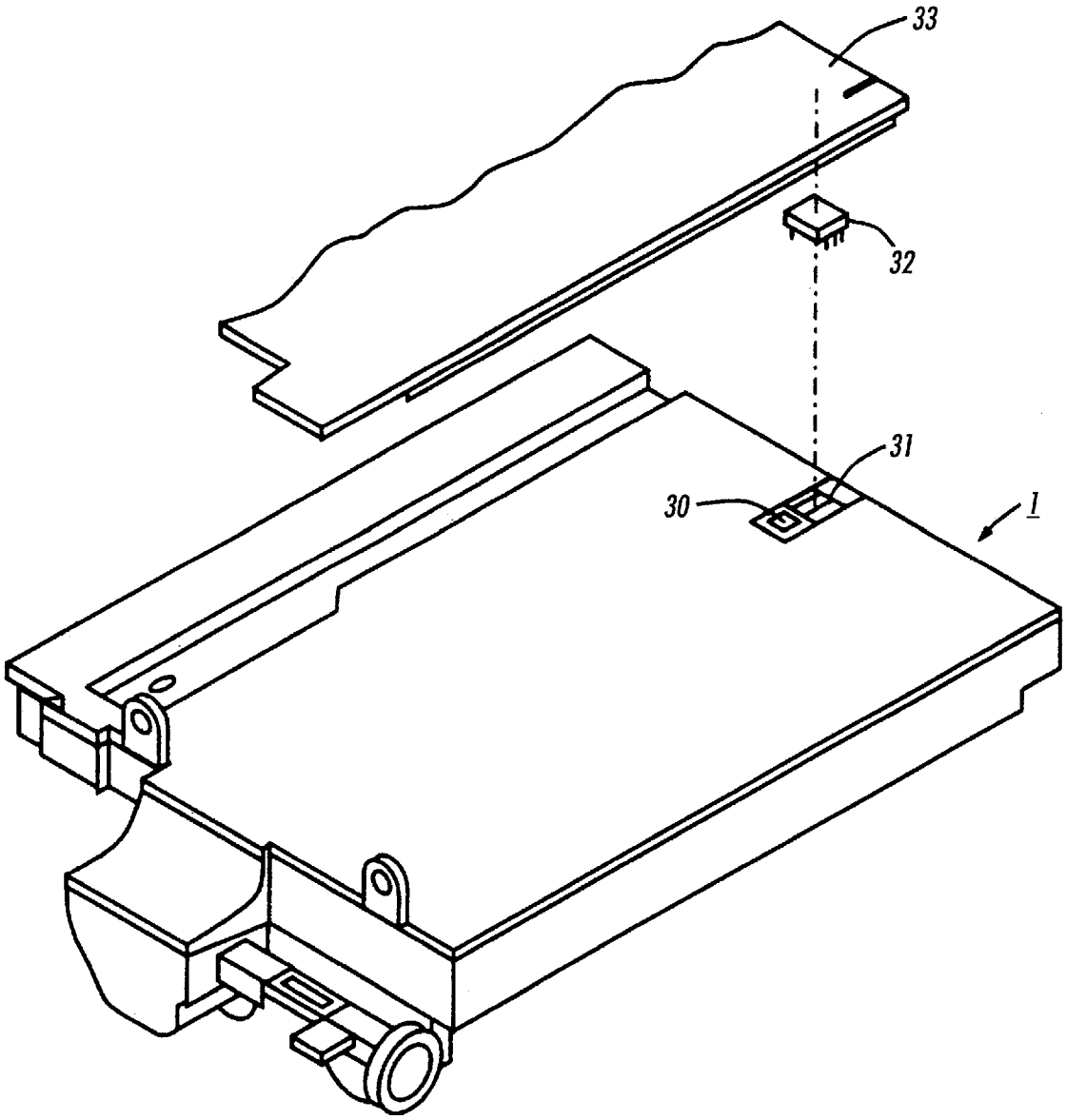
FIG. 3 is a perspective view of the CRU of FIG. 2 in which the connection of the replaceable CRU to the printing machine is shown by way of a partial view.

FIG. 1 shows a laser printer or machine 100 employing a replaceable sub-assembly in the form of a xerographic cassette or print cartridge 1 which is shown in greater detail in FIGS. 2 and 3. A xerographic imaging member in the form of an endless flexible photoreceptor belt is housed within the print cartridge or CRU 1, together with other xerographic process means as described below. A raster output scanner (ROS) 2 provides an imaging beam 3 which is directed at the photoreceptor belt through an imaging slit in the CRU 1 to form an electrostatic latent image on the photoreceptor belt. The image is developed within the CRU 1 and is transferred, at a transfer station 4, to a copy sheet which is fed to that location from one of four supply trays 5, 6, 7 and 8. The transferred image is fused to the copy sheet at a fusing station 9 and the copy sheet may then be delivered from the machine 100 to be collected either in a sample tray 10 on top of the machine 100 or in a stacking tray 11 on the side of the machine 100. Alternatively, a copy sheet with a fused image on one side only may be put into a tray-less duplex path within the machine 100 to be returned to the transfer station 4 to receive an image on the other side before being delivered from the machine 100 into one of the trays 10,11.

The raster output scanner 2 incorporates a laser to generate the imaging beam 3, a conventional rotating polygon device to sweep the imaging beam 3 across the surface of the photoreceptor belt, and an acoustic modulator. The imaging beam 3 is modulated in accordance with image signals received from a remote image source, for example, a use interface and keyboard (not shown). The operation of a raster output scanner of that type to generate a latent image on a photoreceptor is well understood and need not be described here. The processing of the image signals from the remote image source is handled by an electronic sub-system (ESS) of the machine 100, indicated at 15, while operation of the machine 100 generally is under the control of a machine control unit or CPU (not shown here), which includes one or more microprocessors and suitable memories for holding the machine operating software.

CRU 1 may be similar to that described in U.S. Pat. No. 4,827,308. In addition a photoreceptor belt 20 as depicted in FIG. 2, the CRU 1 includes a charge scorotron 21, a developer device 22, a transfer corotron 23, a cleaning device 24, and developer housing 25. The charge scorotron 21 is located upstream of an imaging slit in the CRU 1 to deposit a uniform electrostatic charge on the surface of the photoreceptor belt 20 before photoreceptor belt 20 is exposed to the imaging beam 3. The developer device 22 is located downstream of the imaging slit to bring developer mixture into proximity with, and thereby develop, an electrostatic latent image on the photoreceptor belt 20. The developer mixture is a two-component mixture comprising toner and a magnetically-attractable carrier. Toner is transferred to the photoreceptor belt 20 during image development and replacement toner is dispensed periodically from a hopper (not shown) into the developer housing 25 of the developer device 22. The transfer corotron 23 is located at the transfer station 4 to assist in transferring the developed image from the photoreceptor belt 20 to a copy sheet which enters the CRU 1 at that point. Finally, the cleaning device 24 removes any residual toner particles from the surface of the photoreceptor belt 20 which is then illuminated by a discharge lamp to remove any electrostatic charge remaining on the photoreceptor belt 20.

The CRU 1, as already mentioned, is removable from the machine 100 and can be replaced by another CRU 1 if any of the process elements located therein begin to deteriorate. The CRU 1 has a memory chip or memory 30, as shown in FIG. 3, in the form of an EEPROM (Electrically Erasable Programmable Read Only Memory) mounted in the top cover of the CRU 1. Contact pads 31 are provided on the memory chip 30 so that, when the CRU 1 is inserted into the machine 100, the memory chip 30 is automatically connected to the machine control unit/CPU via a terminal block 32 on a part 33 of the machine 100. When inserted in the machine 100, the memory 30 receives information from the machine control unit/CPU. The memory 30 is preferably of a non-volatile type of memory such as the EEPROM discussed above. It will be well understood that there are many different ways to effect non-volatile memory and all those ways are within the scope of the present invention. For example, conventional ROM (Read Only Memory) is typically volatile and will lose the data contents of its cells when power is removed. However, if ROM is provided with a long life battery on the CRU and if the ROM is of sufficiently low power dissipation, the combination may for all practical purposes effect a non-volatile memory as far as the useful life of the CRU is concerned.

Figure 4:
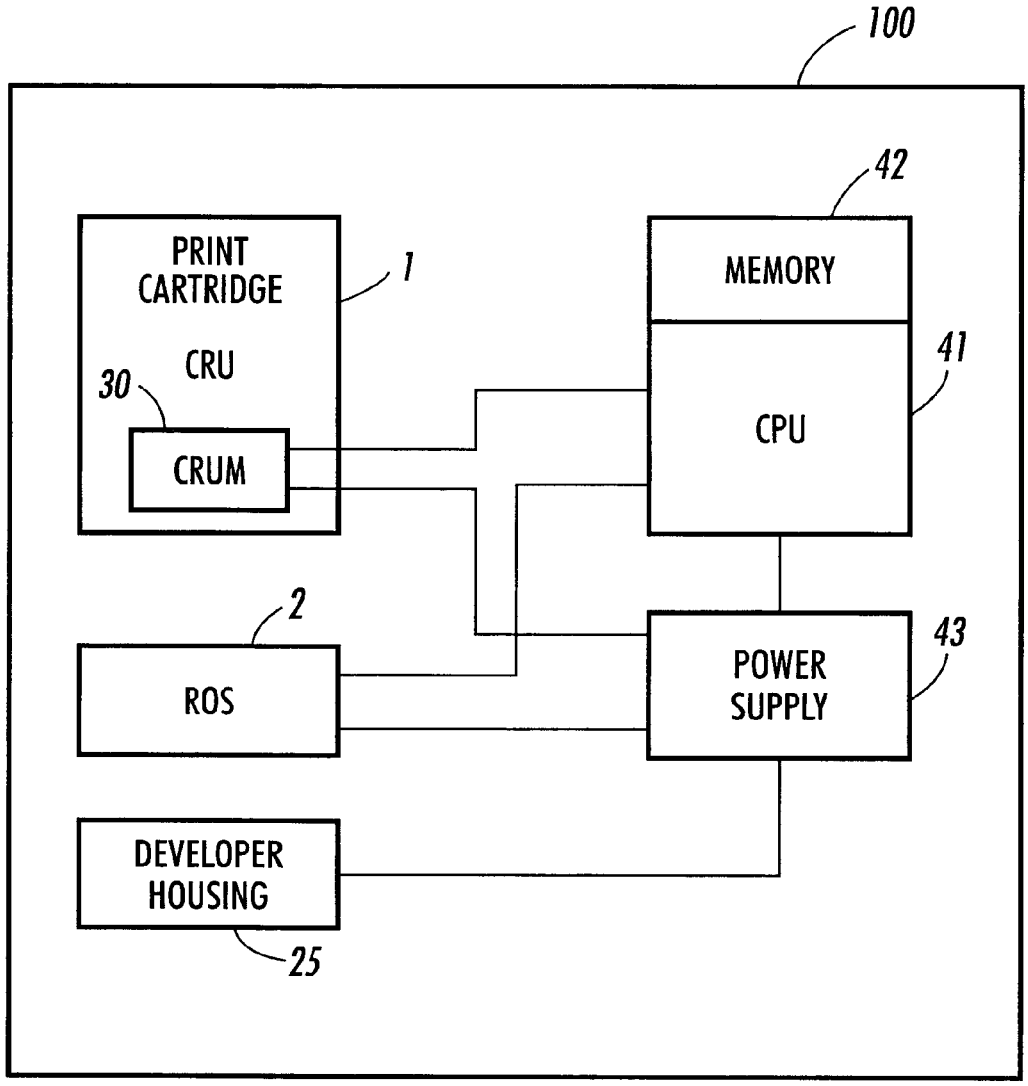
FIG. 4 is a block diagram of the various elements in a machine and their interoperable relationships in fidelity with the teachings of the present invention.

In FIG. 4, there is provided a block diagram of one embodiment which may employ the teachings of the present invention. The machine 100 while a laser printer in this example embodiment, may also be a printer/copier or a fax/scanner/printer or any other such variant. Within machine 100 is a CPU 41 which further comprises its own memory 42 either on the same chip-die or locally off-chip. Memory 42 may include bit maps and other stored parameters for use in setpoints utilized within machine 100. At power up subsequent to when power supply 43 is switched on, a boot sequence in memory 42 which CPU 41 invokes, includes instructions to poll any CRU's resident in machine 100. One example CRU as provided here is CRU 1. As CPU 41 polls replaceable units it checks for indication that there are software updates or tags to invoke. There could be lines of software code or other executable instruction to be read in and substituted. Or in one alternative there may just be a tag indicia that different lines of code or lookup tables (LUT)

are to be invoked in the operation of the machine 100. The tag could be as simple as the setting of a single bit or it could be an address pointing to the location of data, lines of code/executable instructions, or a LUT with lines of code/executable instructions. In all of these possible scenarios above and which follow below, the indicator is one which is shipped with the CRU 1 at time of manufacture or point of distribution.

The CPU 41 may also be provided with code which continually polls for the swapping of a CRU 1. In an alternative obvious to one skilled in the art, the CPU 41 may respond instead to an interrupt from the swapping of a CRU 1. In either case upon determination of a swapped or new CRU 1, the CPU 41 shall poll the CRU 1 and its memory chip or CRUM for indication that there are software updates of executable instructions or new setpoints to invoke.

One example is the situation where a design or manufacturing upgrade to a CRU 1 is made post machine launch to improve photoreceptor aging characteristics. It is desired that machine 100 changes xerographic setpoints as a function of photoreceptor cyclic age by way of executable instructions invoking an algorithm operational in CPU 41. For this embodiment there are a number of equations provided as algorithmic software code or executable instructions as well as parameter arguments or settings distributed in the CRUM 30 as a software upgrade. This code of executable instructions and argument set are loaded into and made resident in the machine stored software for operation in CPU 41. These equations are utilized to calculate the CRU charge voltage, the developer housing bias voltage and the ROS imaging exposure level as a function of photoreceptor age in cycles of machine temperature and machine humidity. These equations as manifest in upgraded executable instruction code contain a number of numerical constants which are tied to the photoreceptor aging rate, temperature and humidity. One example embodiment of such interaction of setpoints and algorithm is found in the operation of the following equation for the ROS exposure:

$$\text{Exposure}=A\times\text{temperature}+B\times\text{Humidity}+C\times\text{number of photoreceptor cycles.}+D.$$

In order to implement a manufacturing change which impacts the aging rate, it would be required to make a change to parameter C. If the photosensitivity to temperature or humidity changes, then the A or B setpoints would change. If the overall photosensitivity changed, then D would need to change.

It is necessary to change the machine system software to accommodate these changes. For machines already in the field this may normally be too prohibitive in cost. With this invention the numerical constants (A,B,C,D) are stored in the CRUM 30 along with the code for the equation above and are read by the machine 100 as software as invoked by CPU 41. So if any material or mechanical upgrade is made to the CRU 1 which improves the aging rate, then the constants stored in the CRUM 30 bit map would also be changed on the manufacturing line to reflect this change. To enable the teaching provided herein of this invention, the machine software for CPU 41 is written as discussed above to read the particular sections of the CRUM 30 which hold the algorithm constants and the algorithm code as upgraded executable software code. Also the machine software is written to use the correct bit map information in its algorithms to update the particular look up tables which are used to set the required power supply voltages or currents, and which are used to set the ROS exposure within the machine 100. When the upgraded CRU 1 is installed into the machine 100, the machine 100 will read the CRUM 30 bit map and automatically upgrade the requisite numbers within its look up tables which will then be used to change the requisite voltages, currents, and exposure when the machine 100 is running in order to take advantage of the new photoreceptor changed aging rate.

This invention can also be used to change machine setup and aging algorithms to solve problems post-launch which may or may not be related to the particular CRU 1 which contains the CRUM 30. For example, a toner cartridge CRUM may provide the above described software code updates for the operation of a CRU 1. This is quite desirable as toner cartridges are typically replaced much more often than printer cartridges. Thus, a post-launch software update or upgrade can be resident in a machine 100 at a much earlier time than if it was distributed by a less often replaced CRU 1.

Indeed, in one embodiment the software which is installed from the CRUM 30 to the CPU 41 and its memory 42 has nothing to do with the medium or media of distribution i.e. the the CRU 1. Instead, the software update/upgrade is in one example to enhance the native operating system, be it for a bug fix or an improved feature set. In another example, it may be an upgrade to the graphic user interface (GUI) so as to allow new menu items, hierarchically reorder menu items or improve "look and feel". It may be simply a personalized work environment optimized for a particular machine customer. The variations achievable are, as will be understood by those skilled in the art, limited only by the storage size of the CRUM 30 or other CRU memory, and the operational boundaries and feature set of the machine 100.

In closing, by employing the CRUM 30 or other CRU memory as the media and the distribution of replaceable cartridges or customer replaceable units (CRU) 1 as a medium of software distribution, software updates/upgrades may be readily distributed from the factory or other central point of distribution post-launch of the target machine without the need for a field service call. Thereby, application of this methodology will allow appropriate software replacement schedules to be instituted for updates/upgrades which minimize both cost and customer down time.

While the embodiments disclosed herein are preferred, it will be appreciated from this teaching that various alternative modifications, variations or improvements therein may be made by those skilled in the art. A CRU may also be called an ERU (Easily Replaceable Unit) which is intended to be replaced by a tech-representative or field engineer rather than a customer. Further, it will be understood by those skilled in the art that the teachings provided herein may be applicable to many types of machines and systems employing CRU's, including copiers, printers and multifunction scan/print/copy/fax machines or other printing apparatus alone or in combination with computer, fax, local area network and internet connection capability.

What is claimed is:

1. A method for operating a machine comprising the steps of:

providing a replaceable sub-assembly separable from the machine, the replaceable sub-assembly further comprising a memory, the memory having stored within a software code upgrade of executable instructions relating to the utilization of the replaceable sub-assembly responsive to a design variance in the customer replaceable unit;

placing the replaceable sub-assembly into the machine;

reading the memory and placing the stored software code upgrade into the machine as new executable instructions; and operating the machine with the replaceable sub-assembly in accordance with the new executable instructions.

2. The method of claim 1 wherein the machine is a printing apparatus.

3. The method of claim 2 wherein the replaceable sub-assembly is a CRU.

4. The method of claim 3 wherein the memory is a non-volatile type of memory.

5. The method of claim 4 wherein the memory is a CRUM.

6. The method of claim 2 wherein the software code upgrade of executable instructions includes parameter arguments.

7. A replaceable sub-assembly for use in a machine at various setpoints comprising:

a memory; and upgraded executable instruction suitable for directing the machine to use the replaceable sub-assembly with different setpoints responsive to a design variance in the customer replaceable unit, where the upgraded executable instruction is stored in the memory.

8. The replaceable sub-assembly of claim 7 wherein the machine is a printing apparatus.

9. The replaceable sub-assembly of claim 8 wherein the replaceable sub-assembly is a CRU.

10. The replaceable sub-assembly of claim 9 wherein the memory is non-volatile memory.

11. The replaceable sub-assembly of claim 10 wherein the memory is a CRUM.

12. The replaceable sub-assembly of claim 9 wherein the CRU is a print cartridge.

13. The replaceable sub-assembly of claim 12 wherein the setpoints relate to photoreceptor aging rate, machine temperature and machine humidity.

14. A method for operating a printer apparatus comprising the step of:

providing a customer replaceable unit separable from the printer apparatus, the customer replaceable unit further comprising a memory, the memory having stored within a software code upgrade of executable instructions relating to the utilization of the customer replaceable unit responsive to a design variance in the customer replaceable unit.

15. The method of claim 14 wherein the memory is non-volatile in type.

16. The method of claim 15 wherein the memory is a CRUM.

17. The method claim of 16 further comprising the step of operating the printer apparatus in accordance with the software code upgrade of executable instructions.

18.The method claim of 16 further comprising the steps of:

reading the CRUM and placing the stored software code upgrade of executable instructions into the printer apparatus as new executable instructions; and operating the printer apparatus in accordance with the new executable instructions.

19. The method of claim 16 wherein the customer replaceable unit is a printer cartridge.

20. The method of claim 19 wherein the software code upgrade of executable instructions comprise equations utilized to calculate charge voltage, developer housing bias voltage, and ROS imaging exposure level as a function of photoreceptor age in cycles of machine temperature and machine humidity.

21. The method of claim 16 wherein the customer replaceable unit is a toner cartridge.

22. The method of claim 16 wherein the software code upgrade of executable instructions includes parameter arguments.

23. The method of claim 22 wherein the parameter arguments relate to photoreceptor aging rate, machine temperature and machine humidity.

* * * * *